US006752648B2

(12) United States Patent
Kashiyama et al.

(10) Patent No.: US 6,752,648 B2
(45) Date of Patent: Jun. 22, 2004

(54) CONNECTOR WITH SLIDER DETECTING HALF-ENGAGEMENT

(75) Inventors: Motohisa Kashiyama, Shizuoka (JP); Yoko Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/096,829

(22) Filed: Mar. 14, 2002

(65) Prior Publication Data

US 2002/0132516 A1 Sep. 19, 2002

(30) Foreign Application Priority Data

Mar. 15, 2001 (JP) ..... P.2001-073470

(51) Int. Cl.[7] ..... H01R 3/00
(52) U.S. Cl. ..... 439/489; 439/352
(58) Field of Search ..... 439/489, 352, 439/357, 358

(56) References Cited

U.S. PATENT DOCUMENTS 4,915,643 A 4/1990 Samejima et al.
5,637,009 A 6/1997 Tsuji et al.
5,820,399 A 10/1998 Shirouzu et al.
5,820,400 A * 10/1998 Yamanashi et al. ..... 439/358
6,027,364 A * 2/2000 Fukuda ..... 439/489
6,475,015 B1 * 11/2002 Murakami et al. ..... 439/352

FOREIGN PATENT DOCUMENTS

EP 0 933 835 A2 8/1999
JP 10-50408 2/1998
JP 10-289756 10/1998

* cited by examiner

*Primary Examiner*—Tho D. Ta
*Assistant Examiner*—James R. Harvey
(74) *Attorney, Agent, or Firm*—Sughrue Mion, PLLC

(57) ABSTRACT

In a connector provided with a slider for detecting a half-engagement with respect to a mating connector in accordance with a state of the slider, a resin housing includes a slider receiving section for accommodating the slider and a terminal receiving section for accommodating a terminal connected with an electric wire, which are vertically arranged so as to oppose to each other while defining a gap therebetween. A reinforcing wall member is integrally molded with the housing so as to bridge the slider receiving section and the terminal receiving section in at least one side portion of the housing.

4 Claims, 9 Drawing Sheets

CONNECTOR WITH SLIDER DETECTING HALF-ENGAGEMENT

BACKGROUND OF THE INVENTION

The present invention relates to a connector provided with a slider for detecting a half-engagement with respect to a mating connector in accordance with a state of the slider.

A related half-engagement detecting connector disclosed in Japanese Patent Publication No. 10-50408A will be described with reference to FIGS. 9 through 14.

As shown in FIG. 9, a half-engagement detecting connector 101 is composed of a male connector 102 and a female connector 103. The male connector 102 includes a connector housing 106 formed of synthetic resin and having a terminal receiving section 104 and a slider receiving section 105, a plurality of terminals 107 (See FIG. 10) accommodated in the terminal receiving section 104, a slider 108 slidably accommodated in the slider receiving section 105, and compression springs 109 for urging the slider 108.

The half-engagement detecting connector 101 has such a structure that in a half-engaged state, the male connector 102 and the female connector 103 are forced to be disengaged from each other by a repulsive force of the slider 108 which is urged by the compression springs 109. In short, the half-engagement detecting connector 101 is so constructed that the half-engaged state between the male connector 102 and the female connector 103 may be prevented.

A structure of the male connector 102 will be described with reference to FIGS. 9 through 12.

In the terminal receiving section 104, there are formed a plurality of terminal chambers 110 for respectively containing and retaining a plurality of the terminals 107. The terminal receiving section 104 and the slider receiving section 105 are vertically arranged while being continuous at rear end portions thereof. On the other hand, the terminal receiving section 104 and the slider receiving section 105 are opposed with each other while defining a gap 111 therebetween, at any other portion than the continuous part. The gap 111 is formed as a space for defining a passage for a housing 128 of the female connector 103 which will be described below.

The slider receiving section 105 is a part for accommodating the aforesaid slider 108, and an opening 112 is formed along an engaging direction of the connectors. Guide grooves 113 for guiding both sides of a main body of the slider 108 are provided on both sides of the slider receiving section 105. At respective rear ends of the guide grooves 13, there are formed spring chambers 114 in a tubular shape.

A flexible lock arm 115 is integrally provided in a center portion of the slider receiving section 105 in a cantilevered manner, and extends along an engaging direction of the connectors. A lock projection 116 having a slanted face is provided on the lock arm 115, and a housing lock 117 adapted to be locked with the housing 128 of the female connector 103 which will be described below is formed in a lower part of a front end of the lock arm 115.

In addition, there is formed a stopper projection 118 for preventing displacement of the lock arm 115 itself, in an upper part of the front end of the lock arm 115. There are further formed, on both sides of the lock arm 115, side grooves 119 for allowing an insertion of abutting projections 120 of a flexible slider arm 121 which will be described below.

The above described slider 108 is provided with the slider arm 121 in a cantilevered manner. The slider arm 121 is formed with a pair of the abutting projections 120 at both side ends in a front lower part thereof. The slider arm 121 is provided in a substantially center of the slider body 122. In addition, there is formed a releaser 123 adapted to be depressed when the engagement is released, in a rear end of an upper part of the slider 108. Further, a through groove 124 is formed between the slider arm 121 and the releaser 123, and a pair of spring holders 125 for holding the compression springs 109 are formed on both sides of the rear end in a lower part of the slider 108. A stopper 126 for preventing displacement of the lock arm 115 is formed in a front end of the slider body 122.

On the other hand, as shown in FIGS. 13 and 14, the female connector 103 is composed of the housing 128 formed of synthetic resin and having a plurality of terminal chambers 134 for respectively accommodating and retaining the plurality of the terminals 127 therein. In the housing 128, there is formed an inlet opening 129 at a front end thereof, into which the male connector 102 is inserted. The housing 128 is also provided, on its upper face, with a pair of stopper projections 130 adapted to be abutted against the abutting projections 120 of the slider 108 on occasion of engagement of the connectors, a projection 131 positioned between the stopper projections 130 and having a slanted face adapted to flex the lock arm 115, and an engaging groove 132 positioned at a rear end of the projection 131 and adapted to lock the housing lock 117.

In the above described structure, when the slider 108 is inserted into the slider receiving section 105 from the front of the connector housing 106, with the compression springs 109 retained by a pair of the spring holders 125, the slider body 122 is moved backward in the guide grooves 113. On this occasion, the abutting projections 120 provided on the slider arm 121 at the lower ends of both sides thereof are located inside the side grooves 119 which are provided on both sides of the lock arm 115. Then, the compression springs 109 are housed inside the spring chambers 114, and at the same time, the slider 108 is slidably mounted by fitting the lock projection 116 of the lock arm 115 into the through groove 124 of the slider 108.

In a state before the engagement of the connectors, the slider 108 is pushed forward by a repulsive force of the compression springs 109, and a front end of the releaser 123 is locked with the lock projection 116 in the through groove 124. At the same time, the stopper projection 118 at the distal end of the lock arm 115 is abutted against the stopper 126 on the lower face of the front end of the slider 108 to block an upward displacement of the lock arm 115. Then, as shown in FIG. 10, a plurality of the terminals 107 fitted to ends of electric wires W1 are respectively inserted into the terminal chambers 110 from a back of the connector housing 106, and locked with housing lances inside the terminal chambers 110. In addition, by fitting a locking holder 133 as shown in FIG. 10, the terminals 107 are doubly locked.

On the other hand, as shown in FIGS. 13 and 14, the terminals 127 fitted to respective ends of electric wires W2 are inserted from the rear of the housing 128, and locked with housing lances inside the terminal chambers 134. At the same time, by fitting a locking holder 135, the terminals 127 are doubly locked. Further, conduction springs 136 to be brought into contact with the terminals 127 are mounted in determined positions in the housing 128.

Since the details are disclosed in Japanese Patent Publication No. 10-50408A, description concerning an operation for engaging the male connector 102 with the female connector 103 will be omitted.

By the way, there has been such an anxiety as follows, in the above described male connector 102, because the connector housing 106 has the gap 111 for the engagement with the female connector 103, between the terminal receiving section 104 and the slider receiving section 105.

When the connector housing 106 is molded, it is caused such a deformation of the connector housing 106 that the terminal receiving section 104 and the slider receiving section 105 are brought close to each other due to thermal shrinkage. In case where a user attempts to engage the connectors unaware of such situation, the female connector 103 may interfere with the connector housing 106 and an insertion force may be increased.

SUMMARY OF THE INVENTION

It is therefore an object of the invention to provide a connector provided with a slider for detecting a half-engagement with respect to a mating connector, in which an interference with a mating connector is prevented and a stable engagement of the connectors can be performed.

In order to achieve the above object, according to the present invention, there is provided a connector provided with a slider for detecting a half-engagement with respect to a mating connector in accordance with a state of the slider, the connector comprising:

a resin housing, in which a slider receiving section for accommodating the slider and a terminal receiving section for accommodating a terminal connected with an electric wire are vertically arranged so as to oppose to each other while defining a gap therebetween; and a reinforcing wall member, integrally molded with the housing so as to bridge the slider receiving section and the terminal receiving section in at least one side portion of the housing.

In this configuration, since it is restricted thermal shrinkage which caused such a deformation of the housing when the terminal receiving section and the slider receiving section are brought close to each other when they are molded, a shape of the housing after the molding will be stabilized by the reinforcing wall member. As a result, the mating connector will not interfere with the connector when it is inserted into the gap, so that the connector engagement between the connectors can be conducted smoothly and stably.

Furthermore, since the slider receiving section and the terminal receiving portion opposing via the gap are reinforced, the housing will not be easily damaged even though it has received an outer force for some reason. Still further, the reinforcing wall member also serves as an area for allowing heat at the molding to escape. Thus, effective thermal shrinkage will be performed.

Preferably, the reinforcing wall member bridges a part of the slider receiving section situated in a front portion of the housing and a part of the terminal receiving section situated in a rear portion of the housing.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will be described referring to the accompanying drawings.

Figure 1:
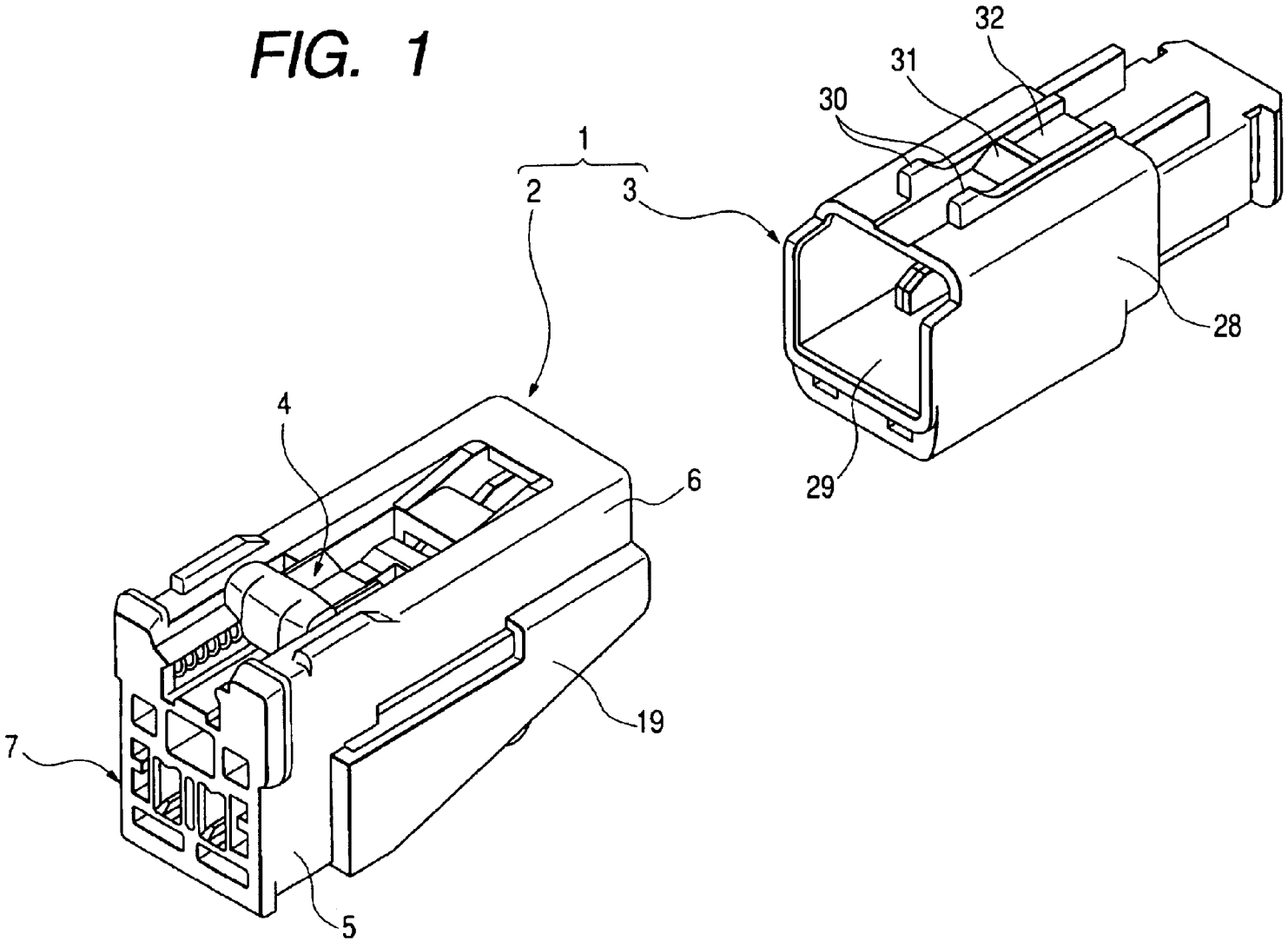
FIG. 1 is an exploded perspective view of a half-engagement detecting connector according to a first embodiment of the present invention.

In FIG. 1, a half-engagement detecting connector 1 which is used in a wiring system for an air bag in an automobile, for example, includes a male connector 2, and a female connector 3 adapted to be engaged with the male connector 2. The half-engagement detecting connector 1 is so constructed that mechanical detection of the engagement can be conducted by an action of a slider 4 provided in the male connector 2.

In other words, the half-engagement detecting connector 1 is constructed in such a manner that when the male connector 2 and the female connector 3 are in a half-engaged state, the male connector 2 and the female connector 3 are forced to be disengaged from each other by a repulsive force of the slider 4 which is resiliently urged.

Figure 2:
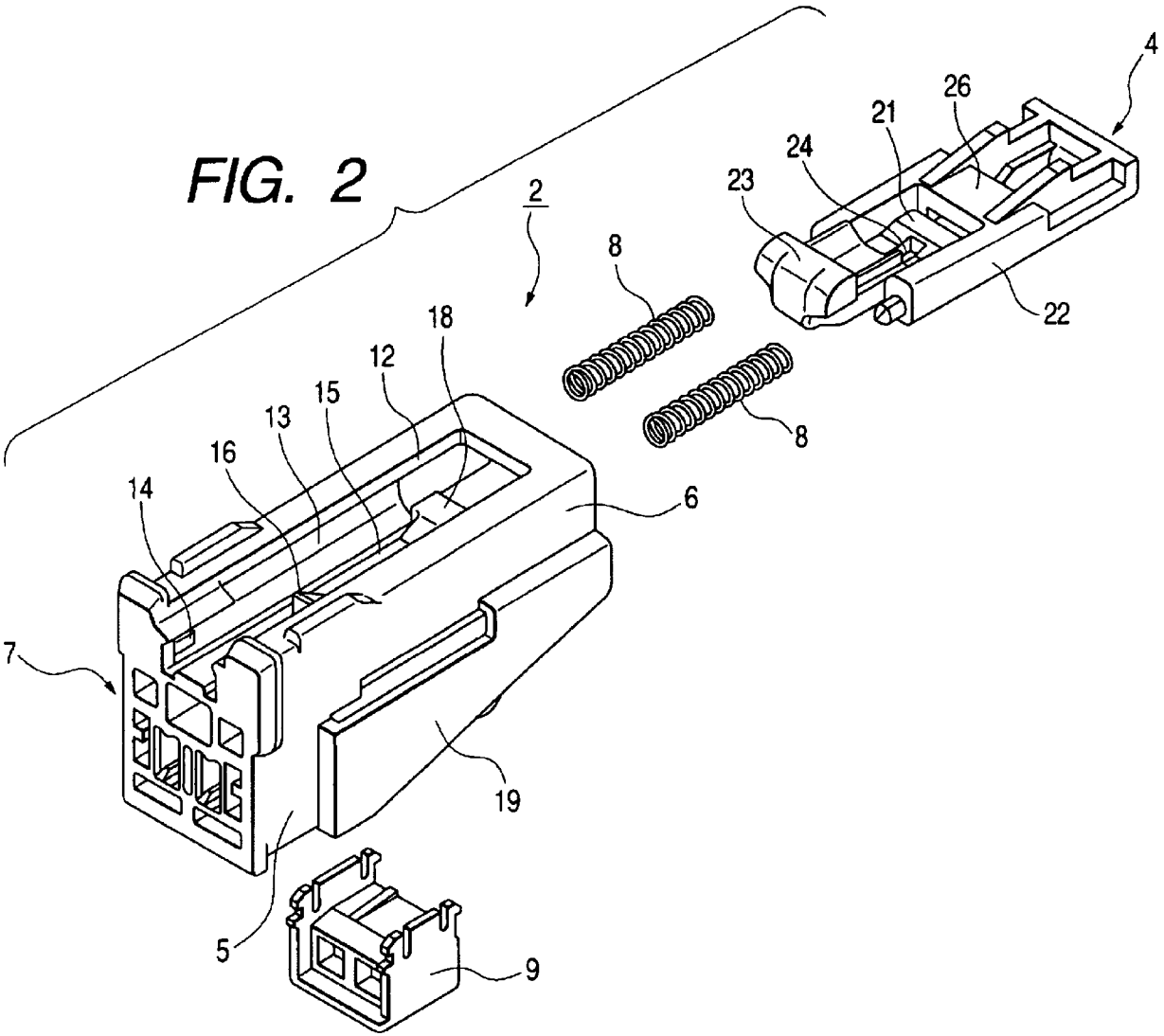
FIG. 2 is an exploded perspective view of a male connector of FIG. 1.
Figure 3:
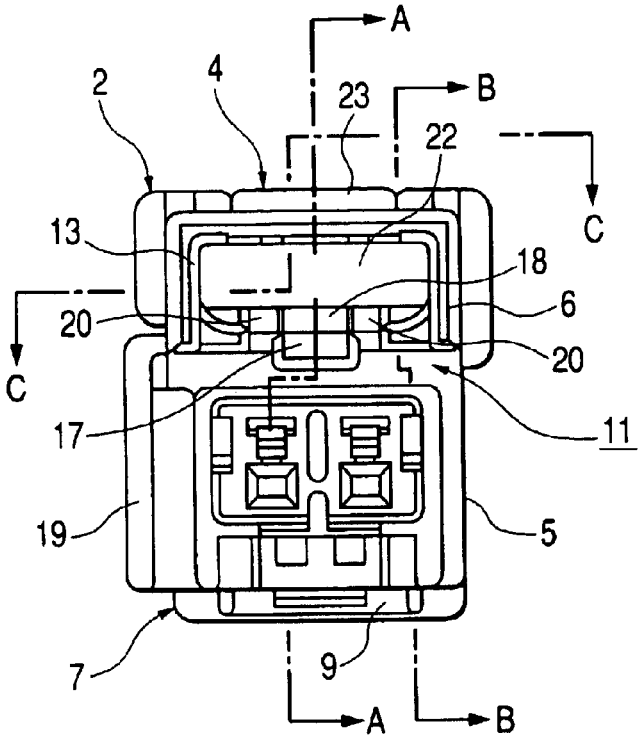
FIG. 3 is a front view of the male connector of FIG. 1.
Figure 4:
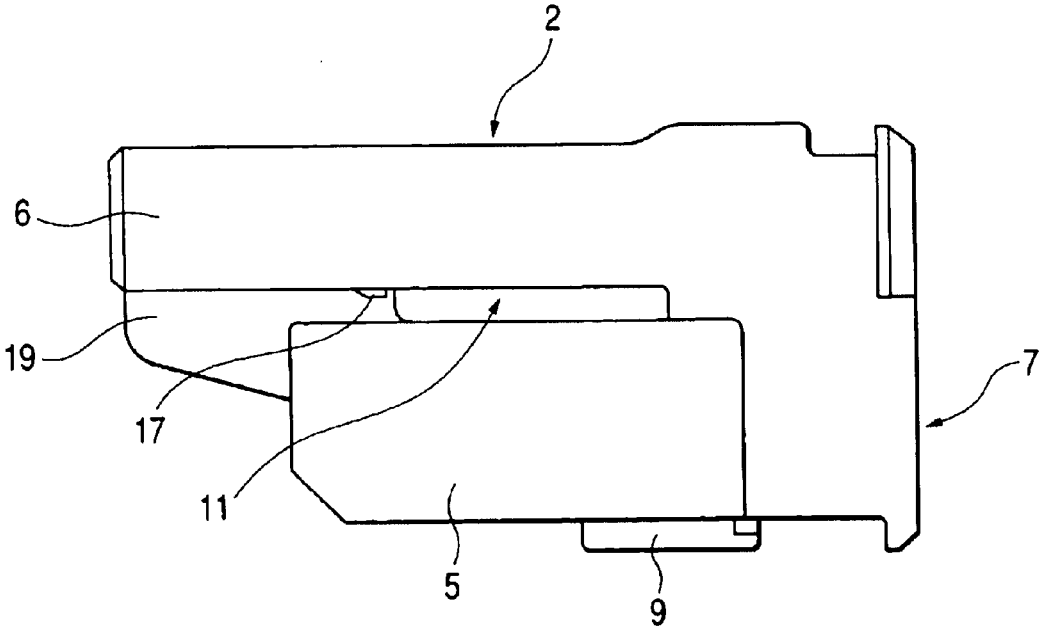
FIG. 4 is a side view of the male connector of FIG. 1.
Figure 10:
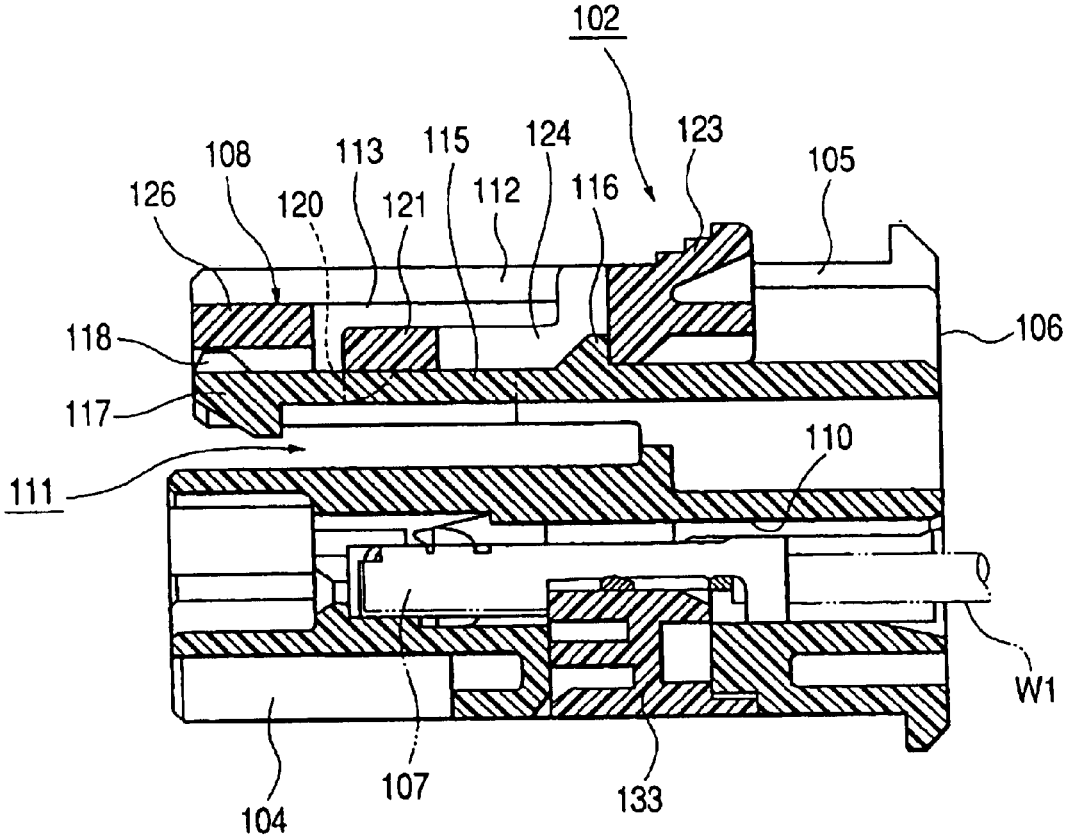
FIG. 10 PRIOR ART
FIG. 10 is a longitudinal sectional view of a male connector of FIG. 9.
Figure 11:
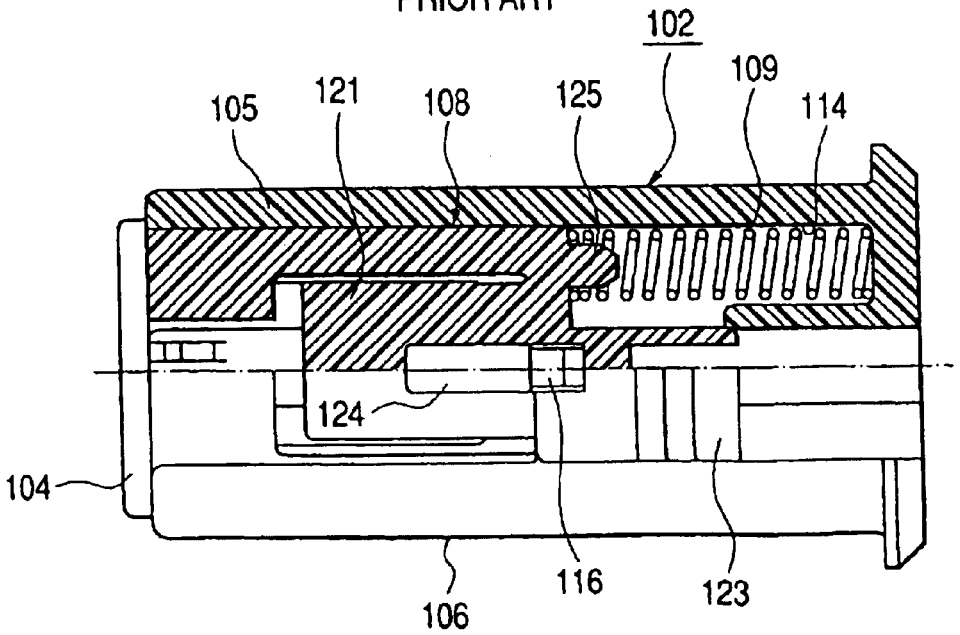
FIG. 11 PRIOR ART
FIG. 11 is a horizontal sectional view of the male connector of FIG. 9.
Figure 12:
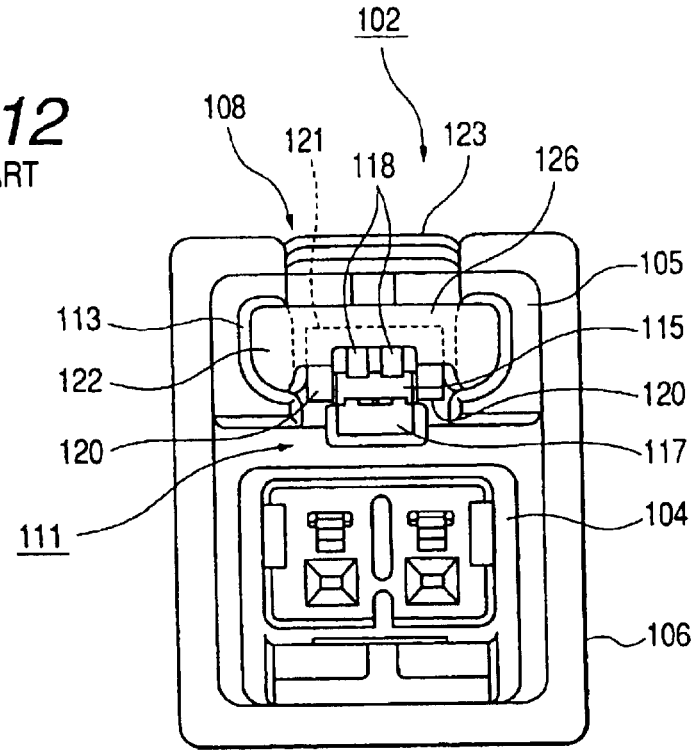
FIG. 12 PRIOR ART
FIG. 12 is a front view of the male connector of FIG. 9.

As shown in FIG. 2, the male connector 2 includes a connector housing 7 formed of synthetic resin and having a terminal receiving section 5 and a slider receiving section 6, a plurality of terminals which are not shown (substantially the same as the terminal 107 in FIG. 10) accommodated in the terminal receiving section 5, a slider 4 formed of synthetic resin and slidably accommodated in the slider receiving section 6, compression springs 8 for urging the slider 4, and a locking holder 9 adapted to doubly lock the aforesaid terminals.

Figure 5:
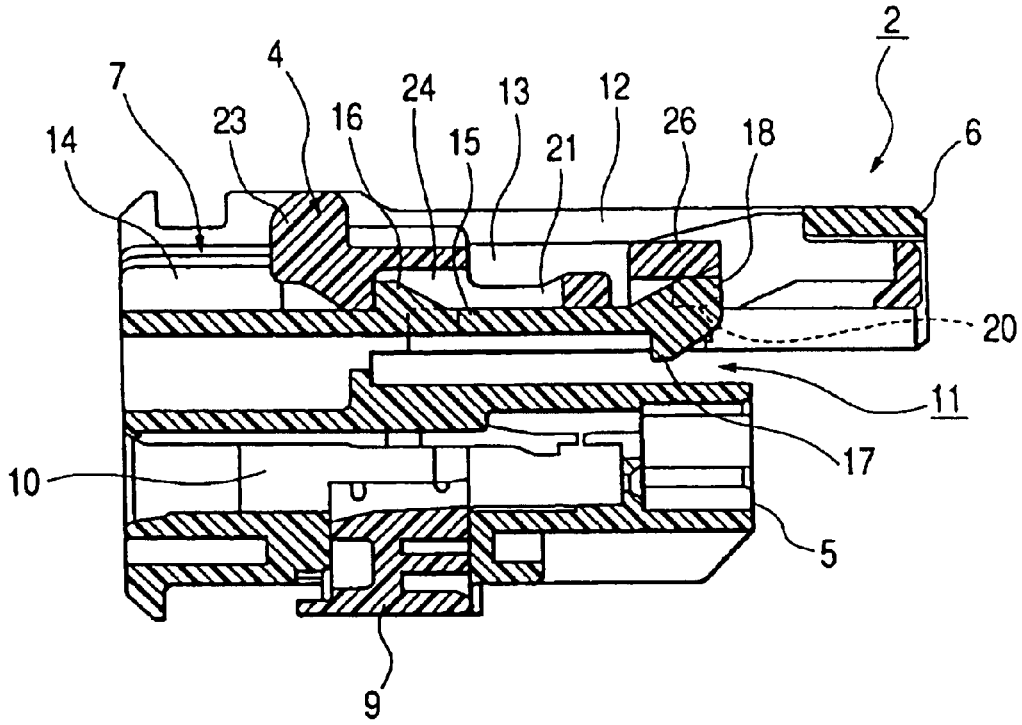
FIG. 5 is a sectional view of the male connector taken along a line A—A in FIG. 3.
Figure 6:
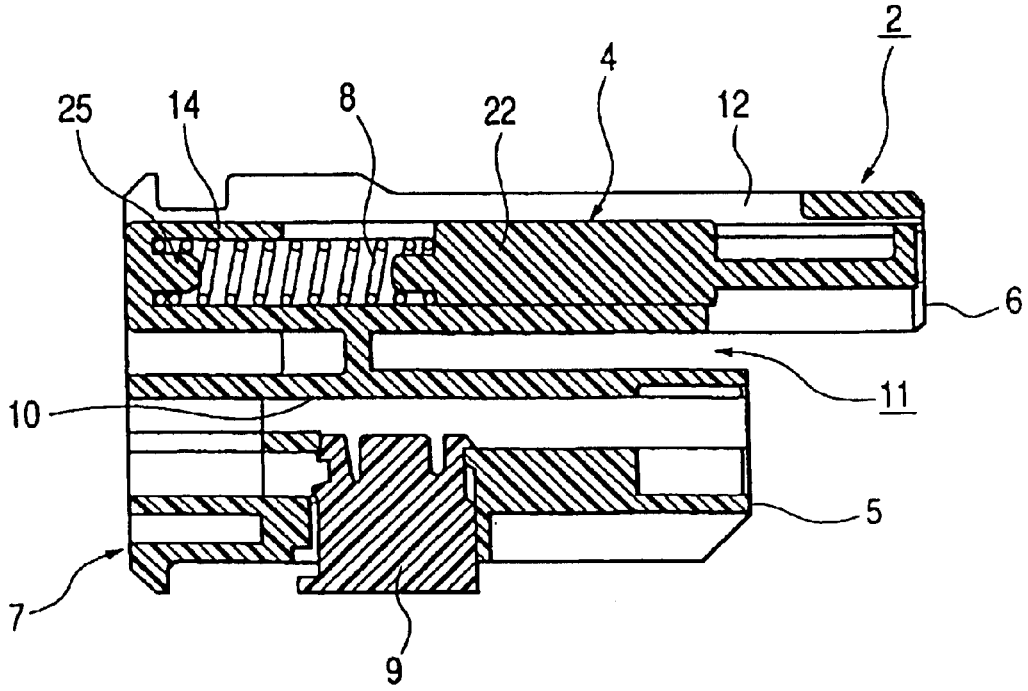
FIG. 6 is a sectional view of the male connector taken along a line B—B in FIG. 3.
Figure 7:
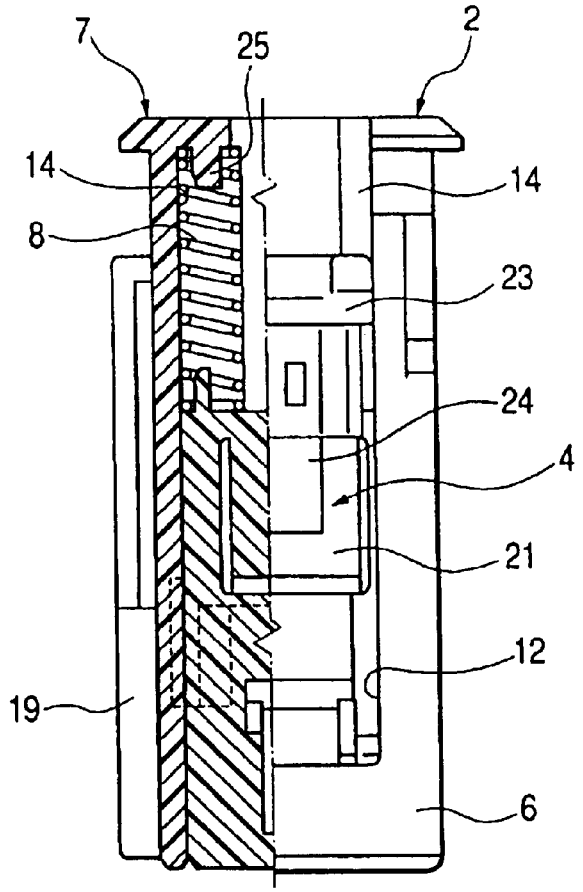
FIG. 7 is a sectional view of the male connector taken along a line C—C in FIG. 3.

In the terminal receiving section 5, as shown in FIG. 5, there are formed a plurality of terminal chambers 10 for respectively accommodating and retaining the terminals. The terminal receiving section 5 and the slider receiving section 6 are vertically arranged while being continuous at rear end portions thereof. On the other hand, the terminal receiving section 5 and the slider receiving section 6 are opposed with each other while defining a gap 11 therebetween, at any other portion than the continuous part. The gap 11 is formed as a space for defining a passage for a housing 28 of the female connector 3 which will be described below.

The slider receiving section 6 is a part for accommodating the aforesaid slider 4, and an opening 12 is formed along an engaging direction of the connectors. Guide grooves 13 for guiding both sides of a main body of the slider 4 are provided on both sides of the slider receiving section 6. At respective rear ends of the guide grooves 13, there are formed spring chambers 14 in a tubular shape.

A flexible lock arm 15 is integrally provided in a center portion of the slider receiving section 6 in a cantilevered manner, and extends along an engaging direction of the connectors. A lock projection 16 having a slanted face is provided on the lock arm 15, and a housing lock 17 adapted to be locked with the housing 28 of the female connector 3 which will be described below is formed in a lower part of a front end of the lock arm 15.

In addition, there is formed a stopper projection 18 for preventing displacement of the lock arm 15 itself, in an upper part of the front end of the lock arm 15. There are further formed, on both sides of the lock arm 15, side grooves (not shown) for allowing an insertion of abutting projections 20 of a flexible slider arm 21 which will be described below.

On one side of the connector housing 7, there is formed a reinforcing wall 19 substantially in a shape of a triangular plate for restricting thermal shrinkage which causes such a deformation of the connector housing 7 that the terminal receiving section 5 and the slider receiving section 6 are brought close to each other when they are molded. The reinforcing wall 19 is integrally formed on the aforesaid one side so as to bridge the slider receiving section 6 and the terminal receiving section 5. In this embodiment, the reinforcing wall 19 is formed so as to bridge a front end of the slider receiving section 6 and a rear end of the terminal receiving section 5.

Since the aforesaid deformation can be avoided according to the above configuration, a shape of the connector housing 7 after the molding will be stabilized. As the results, the female connector 3 will not interfere with the male connector 2, so that the connector engagement between the male connector 2 and the female connector 3 can be conducted smoothly and stably.

It is to be noted that the reinforcing wall 19 serves also as a reinforcing member for the connector housing 7. In other words, the connector housing 7 will not be easily damaged even though it has received an outer force for some reason. Further, the reinforcing wall 19 also serves as an area for allowing heat at the molding to escape. Thus, effective thermal shrinkage will be performed. Meanwhile, by forming the reinforcing wall 19 on the aforesaid one side only, the aforesaid inner drop can be prevented within a small space.

The above described slider 4 is provided with the slider arm 21 in a cantilevered manner. The slider arm 21 is formed with a pair of the abutting projections 20 at both side ends in a front lower part thereof. The slider arm 21 is provided in a substantially center of the slider body 22.

In addition, there is formed a releaser 23 adapted to be depressed when the engagement is released, in a rear end of an upper part of the slider 4. Further, a through groove 24 is formed between the slider arm 21 and the releaser 23, and a pair of spring holders 25 for holding the compression springs 8 are formed on both sides of the rear end in a lower part of the slider 4. A stopper 26 for preventing displacement of the lock arm 15 is formed in a front end of the slider body 22.

In the above described structure, when the slider 4 is inserted into the slider receiving section 6 from the front of the connector housing 7, with the compression springs 8 retained by a pair of the spring holders 25, the slider body 22 is moved backward in the guide grooves 13. On this occasion, the abutting projections 20 provided on the slider arm 21 at the lower ends of both sides thereof are located inside the side grooves (not shown) which are provided on both sides of the lock arm 15. Then, the compression springs 8 are housed inside the spring chambers 14, and at the same time, the slider 4 is slidably mounted by fitting the lock projection 16 of the lock arm 15 into the through groove 24 of the slider 4.

In a state before the engagement of the connectors, the slider 4 is pushed forward by a repulsive force of the compression springs 8, and a front end of the releaser 23 is locked with the lock projection 16 in the through groove 24. At the same time, the stopper projection 18 at the distal end of the lock arm 15 is abutted against the stopper 26 on the lower face of the front end of the slider 4 to block an upward displacement of the lock arm 15.

Figure 13:
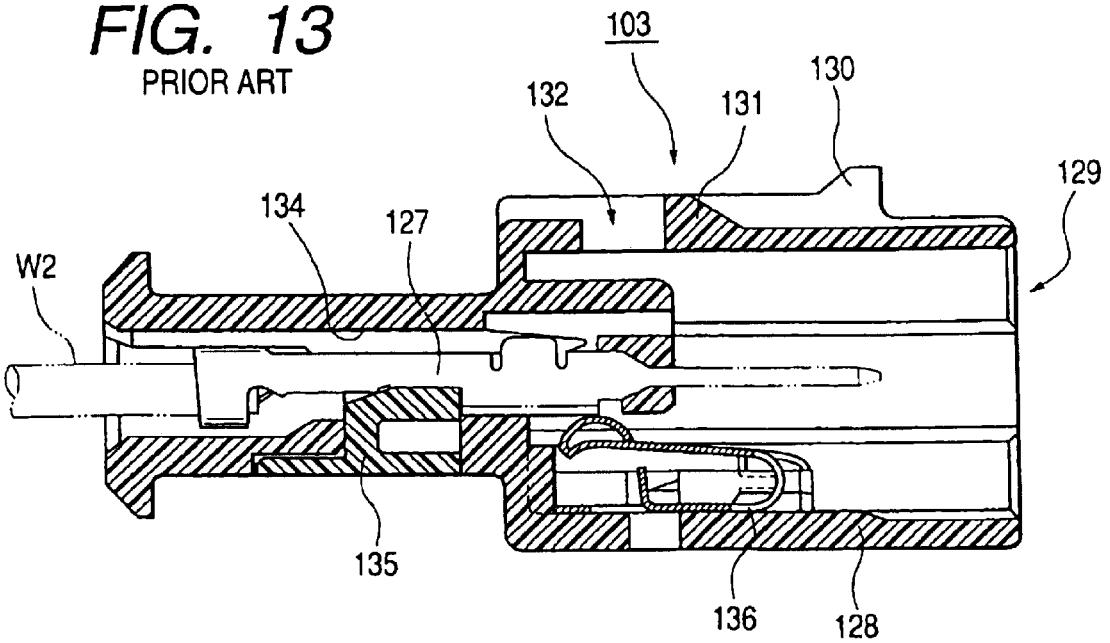
FIG. 13 PRIOR ART
FIG. 13 is a longitudinal sectional view of a female connector of FIG. 9.
Figure 14:
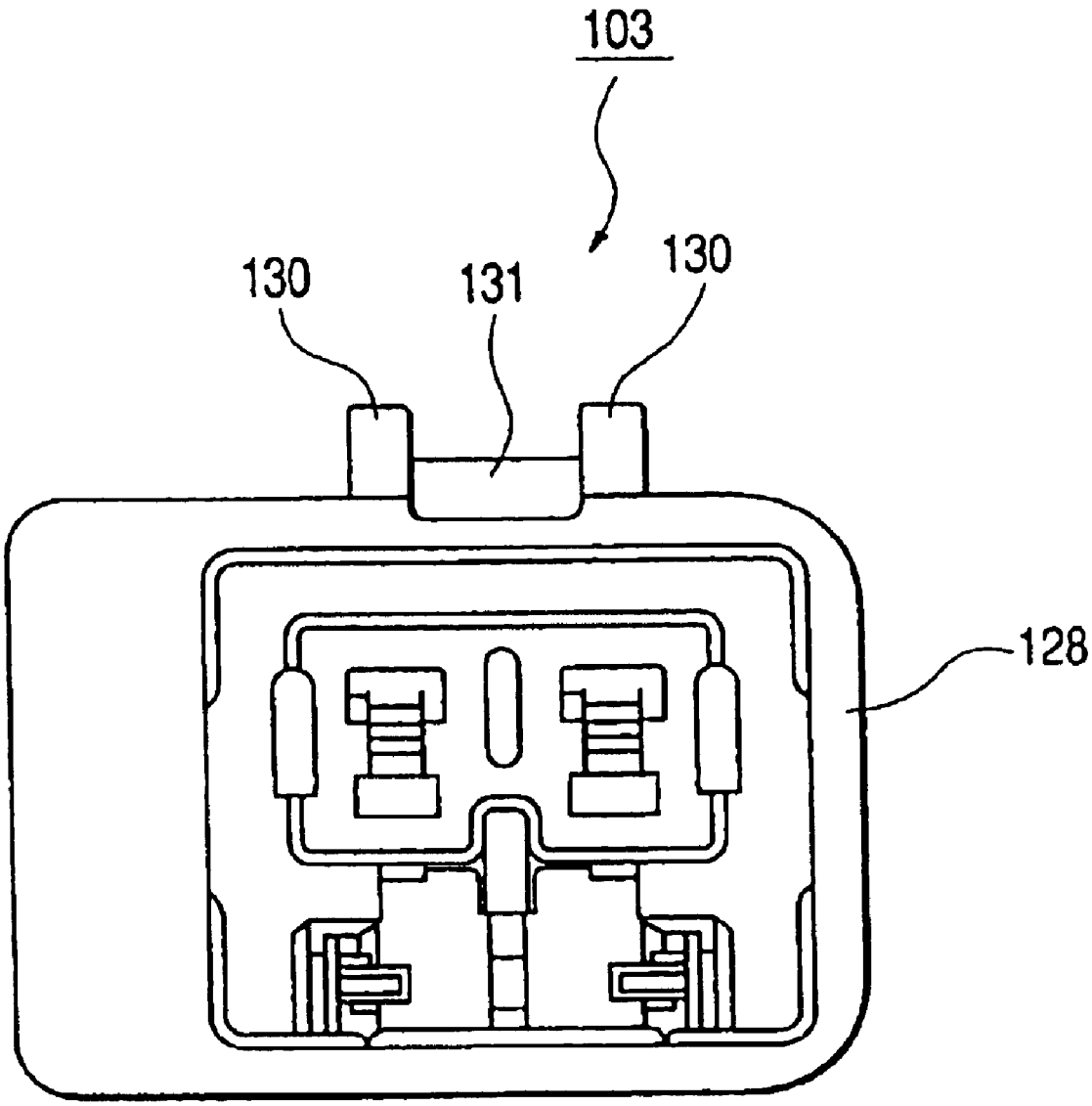
FIG. 14 PRIOR ART
FIG. 14 is a front view of the female connector of FIG. 9.

Referring back to FIG. 1, the female connector 3 is composed of a plurality of terminals which are not shown (substantially the same as the terminal 127 in FIG. 13), and the housing 28 formed of synthetic resin and having a plurality of terminal chambers which are not shown (substantially the same as the terminal chamber 134 in FIG. 13) for respectively accommodating and retaining the plurality of the terminals therein.

In the housing 28, there is formed an inlet opening 29 at a front end thereof, into which the male connector 2 is inserted. The housing 28 is also provided, on its upper face, with a pair of stopper projections 30 adapted to be abutted against the abutting projections 20 of the slider 4 on occasion of engagement of the connectors, a projection 31 positioned between the stopper projections 30 and having a slanted face adapted to flex the lock arm 15, and an engaging groove 32 positioned at a rear end of the projection 31 and adapted to lock the housing lock 17.

Since an operation for engaging the male connector 2 with the female connector 3 is substantially similar to that disclosed in Japanese Patent Publication No. 10-50408A, detailed description will be omitted.

Figure 8:
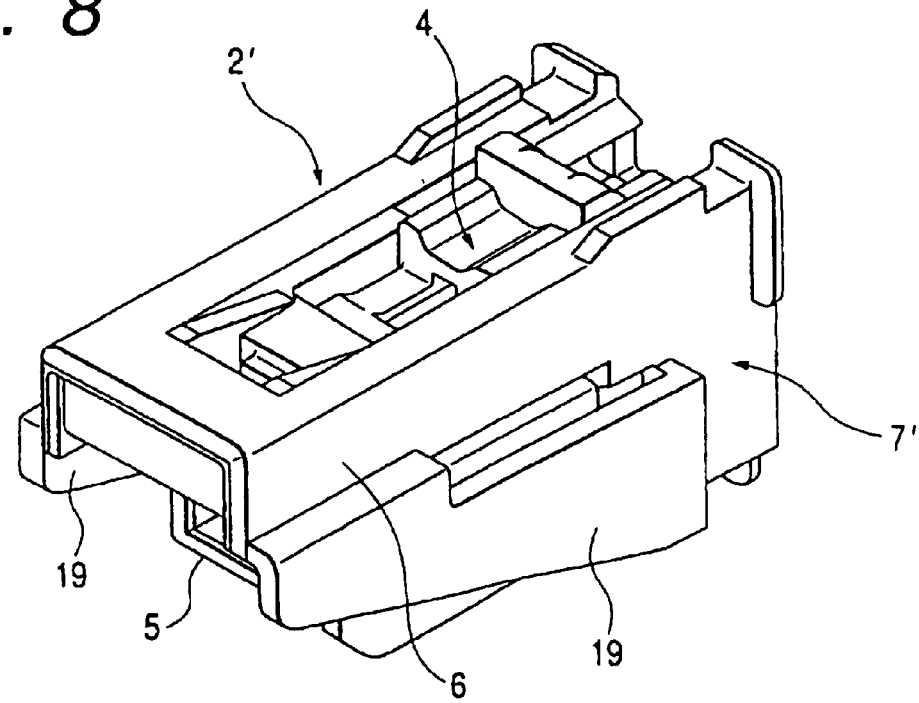
FIG. 8 is a perspective view of an outer appearance showing of a male connector of a half-engagement detecting connector according to a second embodiment of the present invention.
Figure 9:
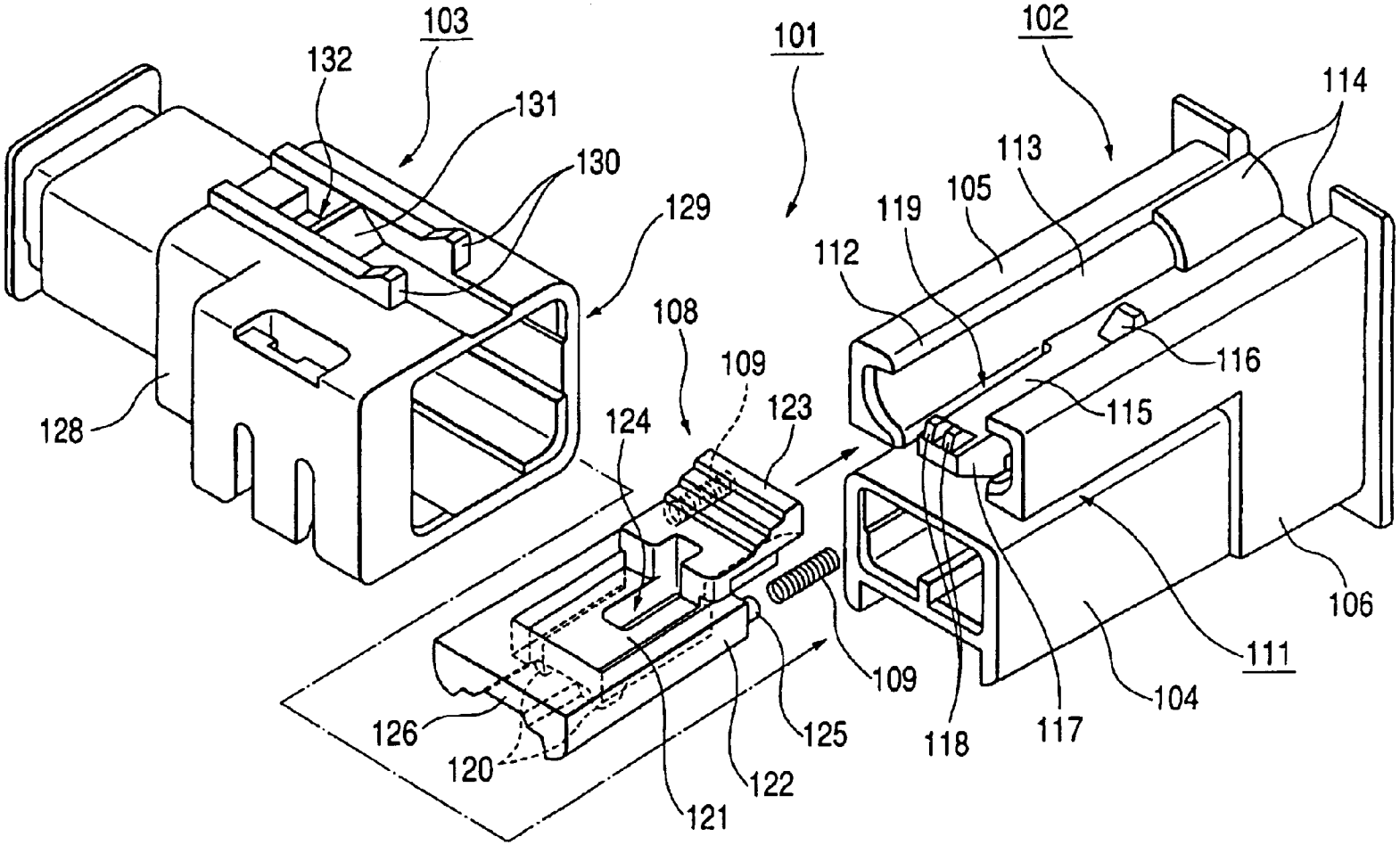
FIG. 9 PRIOR ART
FIG. 9 is an exploded perspective view of a related half-engagement detecting connector.

Further, it is apparent that various modifications can be made in the present invention within a scope not varying a gist of the present invention. Specifically, the reinforcing walls 19 may be formed integrally on both side parts of a connector housing 7' as seen in a male connector 2' as shown in FIG. 8. The same advantages explained with reference to the above embodiment can be also attained.

What is claimed is:

1. A connector provided with a slider for detecting a half-engagement with respect to a mating connector in accordance with a state of the slider, the connector comprising:

a resin housing, including a substantially box-shaped slider receiving housing in which the slider is inserted so as to be slidable therein, and a substantially box-shaped terminal receiving housing in which a terminal connected with an electric wire is inserted, the slider receiving housing and the terminal receiving housing being partly integrated while defining a gap therebetween; and a reinforcing wall member, integrally molded with the housing so as to bridge the slider receiving housing and the terminal receiving housing in at least one side portion of the housing.

2. The connector as set forth in claim 1, wherein the reinforcing wall member bridges a front end part of the slider receiving housing and a rear end part of the terminal receiving housing.

3. The connector as set forth in claim 2, wherein the reinforcing wall is substantially triangular in shape.

4. The connector as set forth in claim 1, wherein the reinforcing wall is molded integrally on each of the side portions of the housing.

* * * * *